US006056183A

United States Patent [19]

Tanabe

[11] Patent Number: 6,056,183

[45] **Date of Patent: *May 2, 2000**

[54] CLINCH MECHANISM IN STAPLER

[75] Inventor: Seiichi Tanabe, Tokyo, Japan

[73] Assignee: Max Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/956,020

[22] Filed: Oct. 22, 1997

[30] Foreign Application Priority Data

Oct. 25, 1996 [JP] Japan ..... 8-301012

[51] Int. Cl.[7] ..... B25C 7/00

[52] U.S. Cl. ..... 227/155

[58] Field of Search ..... 227/155, 88, 85, 227/154

[56] References Cited

U.S. PATENT DOCUMENTS

| | | | |
|---|---|---|---|
| 1,898,205 | 2/1933 | Newhouse | 227/155 |
| 3,170,161 | 2/1965 | Regan | 227/155 |
| 3,804,317 | 4/1974 | Gelzer | 227/155 |
| 4,194,666 | 3/1980 | Spehrley | 227/155 |
| 4,199,095 | 4/1980 | Yamanoi | 227/125 |
| 4,328,919 | 5/1982 | Lawrence | 227/155 |
| 4,593,847 | 6/1986 | Hagemann | 227/155 |
| 5,009,355 | 4/1991 | Akizawa | 227/114 |
| 5,029,745 | 7/1991 | Akizawa | 227/155 |
| 5,076,483 | 12/1991 | Olesen | 227/131 |
| 5,413,266 | 5/1995 | Jairam | 227/155 |

FOREIGN PATENT DOCUMENTS

| | | |
|---|---|---|
| 0 322 906 A2 | 7/1989 | European Pat. Off. . |
| 6-7893 | 3/1994 | Japan . |

*Primary Examiner*—Peter Vo
*Assistant Examiner*—James Calve
*Attorney, Agent, or Firm*—Morgan, Lewis & Bockius LLP

[57] ABSTRACT

A clinch mechanism in a stapler in which legs of a staple penetrating a work are bent in a bending groove, comprises: a pair of right and left movable clinchers being movable in the bending groove in an operative direction, a pair of receivers formed symmetrical with a center of the bending groove so as to receive the legs of the staple which have penetrated the work, the receivers having guide slopes inclined towards the bending groove, and wall surfaces on the sides of the center of the bending groove wherein the wall surfaces are continuous to ends of the guide slopes which are on the sides of the bending groove such that the wall surfaces are in parallel with the operative direction of the movable clincher.

12 Claims, 4 Drawing Sheets

PRIOR ART

CLINCH MECHANISM IN STAPLER

BACKGROUND OF THE INVENTION

This invention relates to a clinch mechanism in a stapler which bends the right and left legs of a staple which have penetrated a work to be stapled in such a manner that those legs are not overlapped with each other.

The technique that the right and left legs of a staple which have penetrated a work to be stapled are bent with a movable clincher, has been generally known in the art under Japanese Utility Model Publication No. Hei. 6-7893. If, in bending the staple legs with the movable clincher, the legs are overlapped with each other, the material thus stapled is increased in thickness as much. In order to overcome this difficulty, a clinch mechanism has provided as follows: The staple legs are received by a receiver which have penetrated a work to be stapled (hereinafter referred to merely as "a work", when applicable). The receiver has guide slopes which bend the staple legs. In this operation, the two legs of the staple are bent in opposite directions, and therefore the two legs could not be overlapped with each other when bent with the movable clincher.

The abutment surface of the movable clincher against the staple legs is cut on a press, and therefore sometimes it is inclined as shown in FIG. 7(*a*). In this case, the following difficulty may be involved: That is, the stable leg 15 bent by a guide slope 14 may be pushed upwardly by the abutment surface of the movable clincher 16, so that it may be bent back as indicated by the arrow A. As a result, one of the legs 15 may be overlapped with the other leg 15 as shown in FIG. 7(*b*).

SUMMARY OF THE INVENTION

Accordingly, an object of the invention is to eliminate the above-described difficulty. More specifically, an object of the invention is to provide a clinch mechanism for a stapler which is free from the difficulty that the staple legs bent by the guide slopes are bent back.

The foregoing object of the invention has been achieved by the provision of a clinch mechanism for a stapler in which a pair of right and left movable clinchers are arranged in a bending groove formed in a clinch section of the stapler, a pair of receivers are formed symmetrical with the center of the bending groove which are adapted to receive the legs of a staple which have penetrated a material to be stapled, the receivers having guide slopes which are inclined towards the bending groove, so that, when the material is stapled, the guides surfaces bend the legs in the opposite directions in such a manner that the legs thus bent embrace the back of the staple so as to be led into the bending groove, and the movable clinchers bend the legs in such a manner that the legs are not laid on each other. The receivers have wall surfaces on the sides of the center of the bending grooves. The wall surfaces are continuous to the ends of the guide slopes which are on the sides of the bending groove in such a manner that the wall surfaces are in parallel with the directions of operation of the movable clincher.

In the clinch mechanism, it is preferable that the surfaces of protruded walls having the wall surfaces which confront with the guide slopes, are formed oblique.

DETAILED DESCRIPTION OF THE PREFERRED EMBODIMENTS

Figure 1:
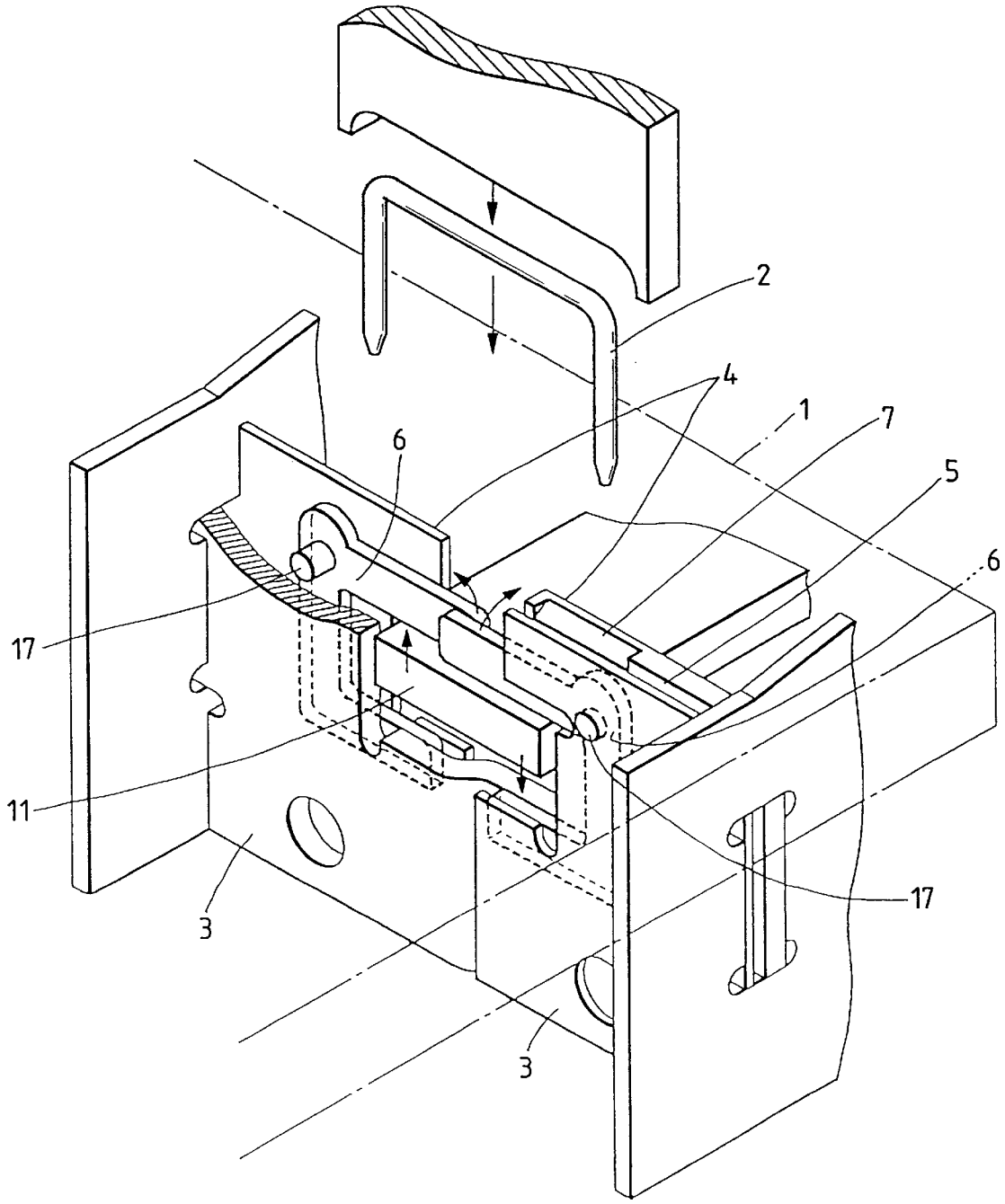
FIG. 1 is a perspective view showing a clinch section in a stapler according to the invention.

FIG. 1 shows a clinch section in a stapler. The clinch section comprises: a clinch mechanism; and a work stand (not shown) located above the clinch mechanism on which a work 1 to be stapled is placed. Above the clinch section, a hammering mechanism (not shown) is provided which hammers a staple 2 towards a work 1.

Figure 2:
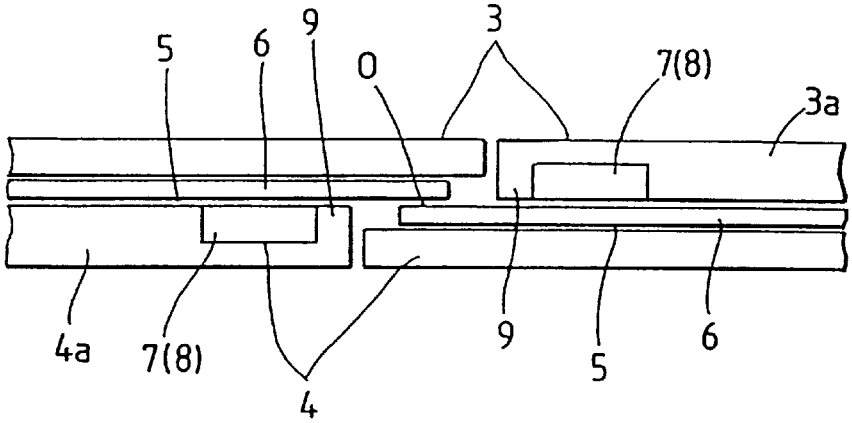
FIG. 2 is a plan view showing the clinch section shown in FIG. 1.
Figure 3:
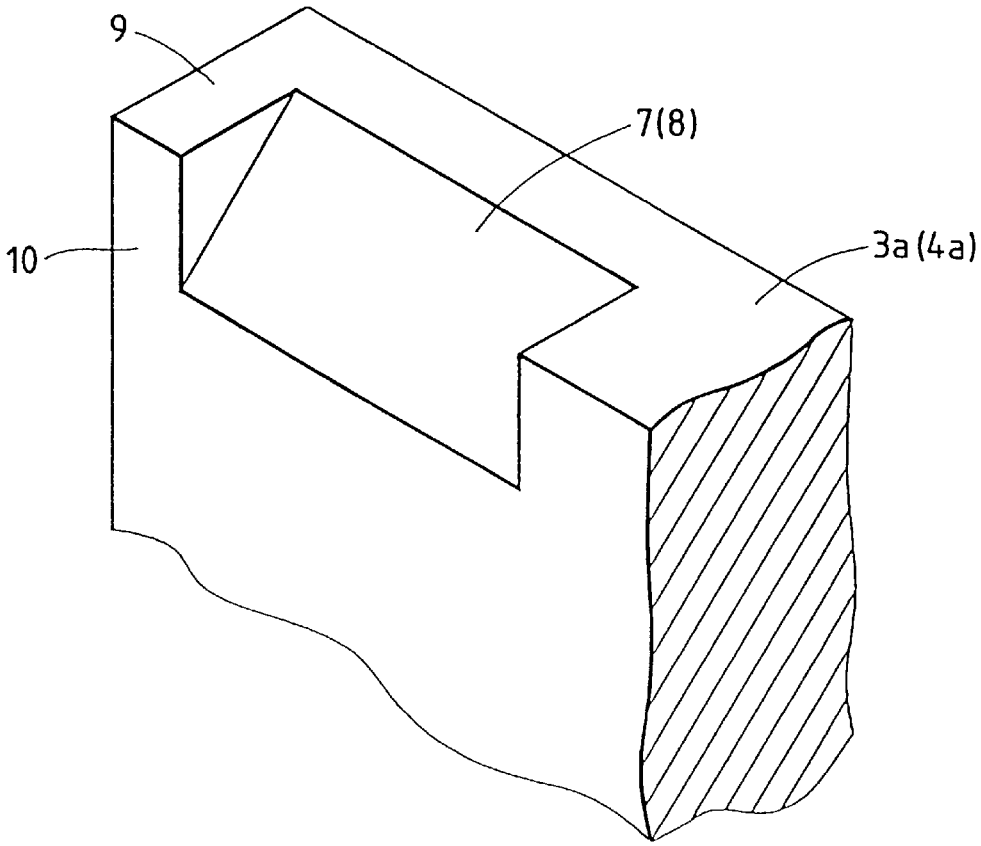
FIG. 3 is a perspective view of part of a receiver in the clinch section showing in FIG. 1.

The clinch mechanism is designed as shown in FIGS. 2 and 3. That is, in the clinch section, first and second stationary wall members 3 and 4 are arranged in a front-to-rear direction. In a bending groove 5 between the first and second stationary wall members 3 and 4, a pair of right and left movable clinchers 6 are arranged. In addition, two receivers 7 are provided which receive two legs of a staple which have penetrated the work 1. The movable clinchers 6 are U-shaped, and their shoulders are rotatably supported through supporting shafts 17 on the first and second stationary wall members 3 and 4.

That is, the first stationary wall members 3 and the second stationary wall members 4 are each a pair of plate-shaped members which are different in thickness from each other as viewed in a front-to-rear direction. The ends of the legs of the staple 2 which have penetrated the work 1 to be stapled, are moved downwardly and struck against the upper surfaces of the plate-shaped members 3*a* and 4*a* which are a little thicker than the bending groove 5. The upper surfaces of the thick plate-shaped members 3*a* and 4*a* of the first and second stationary wall members 3 and 4, have receivers 7 which are adapted to receive the ends of the legs 2*a* of the staple 2, respectively. The two receivers 7 are arranged symmetrically with respect to the center O of the bending groove 5. In addition, the two receivers 7 have guide slopes 8, respectively, which are inclined oppositely. More specifically, the guide slopes 8 are to guide the legs 2*a* of the staple 2 towards the bending groove 5 which have struck against the receivers 7. Hence, the legs 2*a* are bent towards the bending groove 5; however, it should be noted that they are bent in the opposite directions.

Each of the receivers 7 has a protrusion 9 near the center of the bending groove 5. Each of the protrusions 9 has a wall 10 on the side of the bending groove 5 in such a manner that it is continuous to the end of the guide slope 8 which is on the side of the bending groove 5, and is in parallel with the directions of operation of the movable clinchers 6.

The movable clinchers 6 is each turned by the vertical (up and down) operation of a drive means 11. The drive means 11 is so designed that it operates in association of the operation of a hammering mechanism adapted to hammer a staple 2 towards the work 1 to be stapled, and is operated after the staple 2 has been hammered.

Figure 4A:
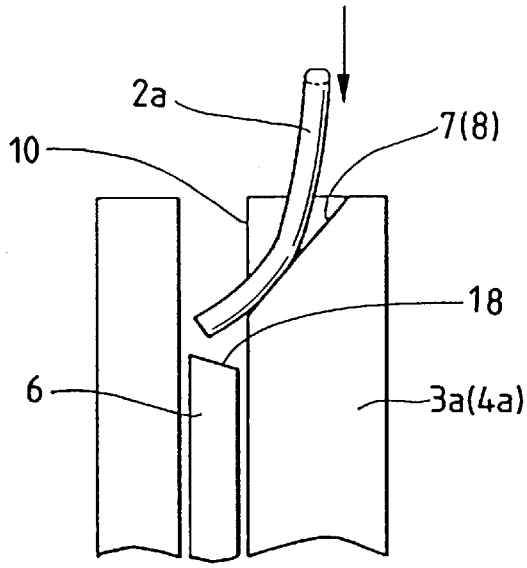
FIGS. 4(*a*) and 4(*b*) are explanatory diagrams for a description of a staple bending operation.
Figure 4B:
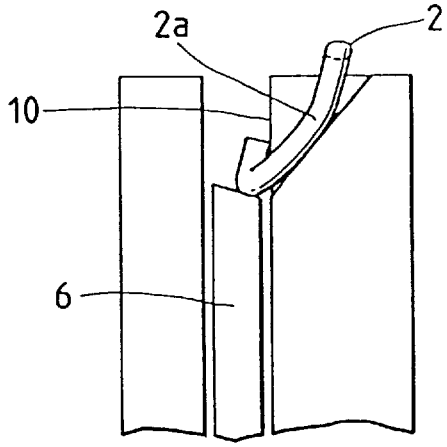
Figure 5:
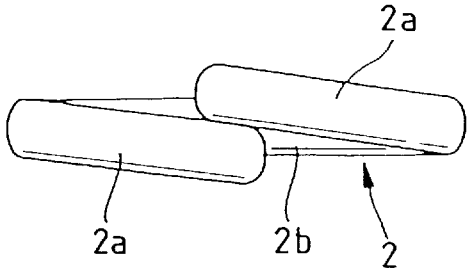
FIG. 5 is a diagram showing a staple which has been bent.

When the hammering mechanism hammers the staple 2 towards the work 1 to be stapled, the legs of the staple 2 penetrate the work 1, and are struck against the receivers 7 of the first and second stationary wall members 3 and 4, and then caused to go into the bending groove 5 while being guided by the guide slopes 8. As a result, the legs 2*a* are bent in the opposite directions in such a manner as to embrace the back of the staple 2. Thereafter, the drive means 11 of the clinch mechanism operates to turn the movable clinchers 6, so that the upper surfaces 18 of the movable clinchers 6 push up the legs 2*a* to bend the legs 2*a*. In this operation, because of the inclination of the upper surfaces of the movable clinchers 6, the legs 2*a* of the staple 2 which have been bent, are bent back. In this case, the ends of the legs 2*a* thus bent are caused to move along the wall surfaces 10 of the protrusions 9. The wall surfaces 10 are in parallel with the directions of operation of the movable clinchers 6. This feature prevents the leg 2*a* which has been bent as shown in FIG. 4(*b*) from being bent back. Hence, when the bending operation by the movable clinchers 6 has been accomplished, as shown in FIG. 5, the legs 2*a* are bent in the opposite direction in such a manner that they embrace the back of the staple 2 and are not laid on each other; that is, they are "bypass-clinched".

As was described above, the protrusions 9 are provided near the guide slopes 8, and the protrusions 9 prevent the legs 2*a* of a staple 2 which have been bent by the guide slopes 8 from being bent back when they are bent by the movable clinchers 6. Hence, the legs 2*a* of the staple 2 can be bent at all times in such a manner that they are not laid on each other.

Figure 6:
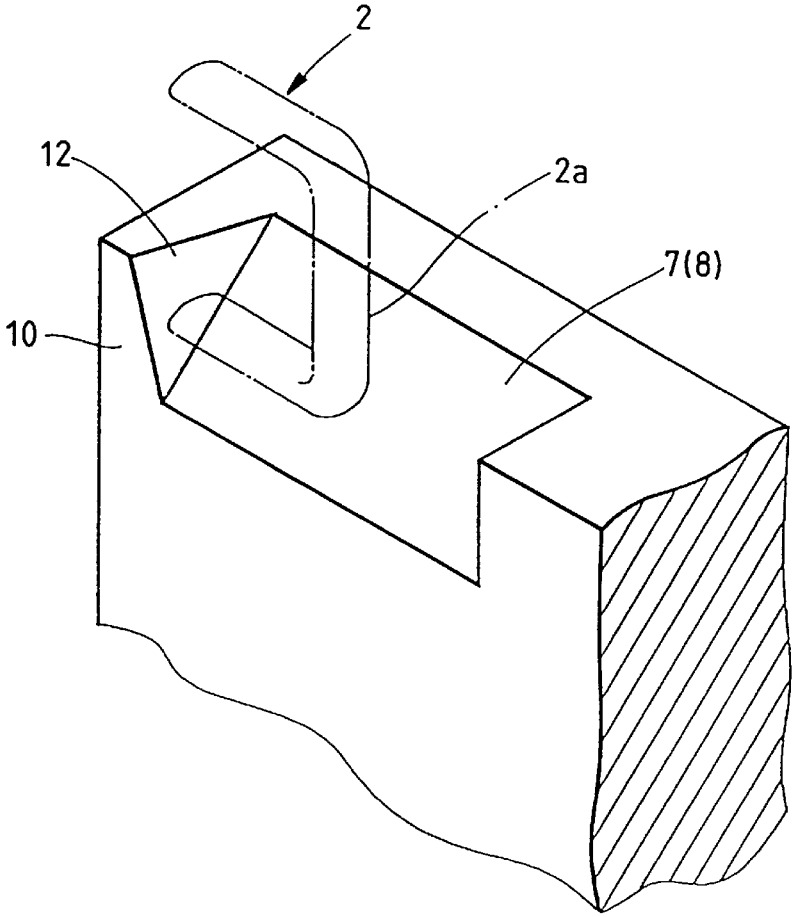
FIG. 6 is a perspective view of another embodiment of the clinch section.
Figure 7A:
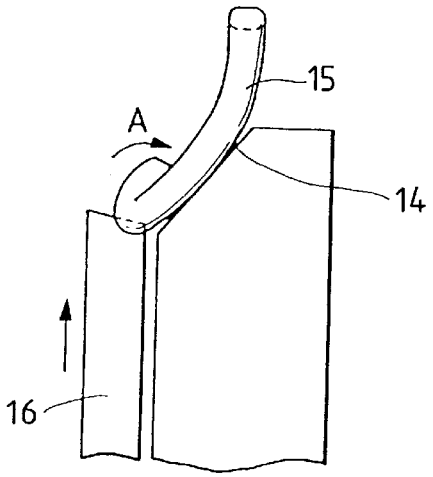
FIG. 7(*a*) is an explanatory diagram for a description of a staple bending operation with a conventional stapler, and FIG. 7(*b*) is a diagram showing a staple which has been bent with the conventional stapler.
Figure 7B:
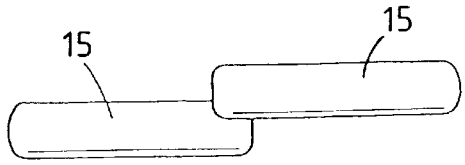
PRIOR ART FIG. 7(b)

FIG. 6 shows another example of the protrusions 9. In this case, the wall surface 12 of each of the protrusion 9 is inclined which is confronted with the guide slope 8. This structure has the following merit. There may be a case where a work 1 to be stapled is thick, and the legs 2*a* of a staple 2 which have penetrated it are not long enough. Even if, in such a case, the legs 2*a* of the staple 2 which have been bent by the movable clinchers 6 are struck against the inclined wall surfaces 12, the ends of the legs 2*a* are moved along the inclined wall surfaces. This feature eliminates the difficulty that the legs are unsatisfactorily bent.

What is claimed is:

1. A clinch mechanism of a stapler in which legs of a staple penetrating a workpiece are bent in a bending groove having a center, the clinch mechanism comprising:

a right movable clincher and a left movable clincher, each clincher being pivotally movable in the bending groove in an operative direction defining a plane of movement of said clincher and each having an angled side for engaging a corresponding leg of the staple; and a pair of receivers disposed symmetrically about the center of the bending groove so as to receive the legs of the staple which have penetrated the workpiece, each of the receivers including:

a wall member including a side defining a side of the bending groove, a guide slope inclined towards the bending groove, and a protrusion that extends from and defines an end of the guide slope, and a wall surface on said protrusion, wherein said wall surface is located adjacent an end of the respective guide slope such that said wall surface is parallel to the operative direction of the clinchers, wherein each leg of said staple engages a guide slope to be bent toward said plane of movement after penetrating the workpiece, and engages said angled side of one of said clinchers when said angled side is oriented downwardly at an angle with respect to a horizontal plane so that as the clincher pivots upwardly the staple leg is bent at an angle away from said plane of movement and toward said wall surface.

2. The clinch mechanism according to claim 1, wherein each of the receivers further comprises a side wall located adjacent to and obliquely confronting a guide slope, the staple leg engaging said side wall to be bent after engaging said clincher.

3. The clinch mechanism according to claim 1, wherein the staple leg engages and moves along said wall surface to be bent.

4. The clinch mechanism according to claim 1, wherein the angled side of said each clincher is inclined inwardly with respect to an axis of a back portion of the staple.

5. A clinch mechanism of a stapler defining a bending groove in which legs of a staple penetrating a workpiece are bent by a movable clincher, the clincher having an angled side for engaging a leg of the staple, the clincher pivotally movable in a plane of movement, each leg receiver comprising:

a wall member including a side defining a side of the bending groove, a guide slope inclined towards the bending groove, and a protrusion that extends from and defines an end of the guide slope, and a wall surface on said protrusion, wherein said wall surface is located adjacent an end of the respective guide slope such that said wall surface is parallel to the operative direction of the movable clincher, wherein each leg of said staple engages a guide slope to be bent toward the plane of movement after penetrating the workpiece, and engages the angled side of the clincher when the angled side is oriented downwardly an angle with respect to a horizontal plane so that as the clincher pivots upwardly the staple leg is bent at an angle away from the plane of movement and toward said wall surface.

6. The pair of leg receivers according to claim 5, wherein each receiver further comprises a side wall located adjacent to and obliquely confronting said guide slope, the staple leg engaging said side wall to be bent after engaging said clincher.

7. The clinch mechanism according to claim 5, wherein the staple leg engages and moves along said wall surface to be bent.

8. A clinch mechanism for a stapler in which legs of a staple penetrating a workpiece are bent, the clinch mechanism comprising:

receivers for receiving the legs of the staple which have penetrated the workpiece, each receiver comprising first and second wall members, said first wall member comprising a guide structure including a guide slope inclined toward said second wall member, a protrusion extending from and defining an end of the guide slope closest to the second wall member of another receiver, and a wall surface on said protrusion, wherein the clinch mechanism defines a bending groove in which the legs of the staple are bent, the bending groove being defined by said first and second wall members of said receivers and said wall surface; and clinchers pivotally movable in said bending groove in an operative direction defining a plane of movement, each clincher having an angled side to engage a corresponding staple leg, wherein each staple leg engages a guide slope to be bent toward the plane of movement after penetrating the workpiece, and engages said angled side of one of said clinchers when said angled side is oriented downwardly at an angle with respect to a horizontal plane so that as the clincher pivots upwardly the staple leg is bent at an angle away from the plane of movement and toward said wall surface.

9. The clinch mechanism according to claim 8, wherein said protrusion extends substantially perpendicular from said guide slope.

10. The clinch mechanism according to claim 8, wherein said side wall extends substantially obliquely from said guide slope, the staple leg engaging said side wall to be bent after engaging said clincher.

11. The clinch mechanism according to claim 8, wherein the staple leg engages and moves along said wall surface to be bent.

12. The clinch mechanism according to claim 8, wherein the angled side of said each clincher is inclined inwardly with respect to an axis of a back portion of the staple.

* * * * *